United States Patent [19]

Piotrowski

[11] 4,292,046

[45] Sep. 29, 1981

[54] DETERGENT COMPOSITIONS

[75] Inventor: Alfred B. Piotrowski, Woodbury, N.Y.

[73] Assignee: Mobil Oil Corporation, New York, N.Y.

[21] Appl. No.: 65,703

[22] Filed: Aug. 10, 1979

[51] Int. Cl.[3] ..... C10L 1/22
[52] U.S. Cl. ..... 44/63
[58] Field of Search ..... 44/63; 548/352, 349, 548/350

[56] References Cited

U.S. PATENT DOCUMENTS

| | | | |
|---|---|---|---|
| 2,907,646 | 10/1959 | O'Kelly et al. | 44/63 |
| 3,036,902 | 5/1962 | Hamer et al. | 44/63 |
| 3,555,041 | 1/1971 | Katz | 548/352 |
| 3,927,995 | 12/1975 | Romans | 44/63 |

*Primary Examiner*—Winston A. Douglas
*Assistant Examiner*—Mrs. Y. Harris-Smith
*Attorney, Agent, or Firm*—C. A. Huggett; M. G. Gilman; H. M. Flournoy

[57] ABSTRACT

1-hydroxyethyl-1-alkyl-2-imidazolines, bis-imidazolines and their derivatives impart good detergent properties to liquid hydrocarbon fuels containing a minor effective amount thereof.

3 Claims, No Drawings

DETERGENT COMPOSITIONS

BACKGROUND OF THE INVENTION

1. Field of the Invention

This invention relates to liquid hydrocarbon fuels normally susceptible to forming undesirable carburetor and intake valve deposits in automative and other internal combustion engines. More particularly this invention relates to liquid hydrocarbon fuels containing additives for effecting reduction of such deposits.

2. Description of the Prior Art

It is well known to those skilled in the art that liquid hydrocarbon fuels, such as gasolines, and fuel oils, tend, on combustion, to form undesirable deposits on carburetor and intake valves in internal combustion engines. The formation of such deposits tends to impair engine efficiency and often results in breakdown, necessitating cleaning operations and, in many instances, costly replacement of engine parts. This situation is particularly encountered in the use of modern liquid hydrocarbon fuels such as gasoline, jet fuel, diesel fuel and other fuels normally employed in the operation of advanced internal combustion engines. Accordingly, means for reducing or preventing the formation of such deposits in internal combustion engines is desirable.

Various additives have been used with varying success in liquid hydrocarbon fuels to overcome the adverse effects described above. However, to applicant's knowledge the imidazolines disclosed herein having not been so used nor suggested by prior art.

SUMMARY OF THE INVENTION

In accordance with the present invention, as more fully hereinafter discussed, it has been found that the aforementioned undesirable formation of carburetor and intake valve deposits in internal combustion engines can be significantly reduced by providing liquid hydrocarbon fuels containing minor amounts of 1-hydroxyethyl-2-alkyl-2-imadazolines, bis-imidazolines and derivatives thereof.

The liquid hydrocarbon fuels improved in accordance with the present invention comprise fuels which are normally susceptible to forming undesirable carburetor and intake valve deposits in internal combustion engines. Specifically liquid hydrocarbon fuels boiling from about 75° F. to about 750° F. including gasoline, jet fuel and diesel fuel. Of particular significance is the treatment of petroleum distillate fuels having an initial boiling point of about 75° F. to about 135° F. and an end boiling point from about 250° F. to about 750° F. It should be noted, in this respect, that the term "distillate fuels" or "distillate fuel oils" is not intended to be restricted to straight-run distillate fractions. These distillate fuel oils can comprise straight-run distillate fuel oils, catalytically or thermally cracked (including hydrocracked) distillate fuel oils or mixtures of straight-run distillate fuel oils, naphthas and the like, with cracked distillate stocks. Moreover, such fuel oils can be treated in accodance with well-known commercial methods such as acid or caustic treatment, hydrogenation, solvent refining, clay treatment and the like.

The distillate fuels are characterized by their relatively low viscosity, pour point and the like. The principle property, which characterizes these hydrocarbons, however, is their distillation range. As hereinbefore indicated, this range will lie between about 75° F. and about 750° F. Obviously, the distillation range of each individual fuel will cover a narrower boiling range, falling, nevertheless, within the above-specified limits. Likewise, each fuel will boil substantially continuously throughout its distillation range.

Particularly contemplated among the fuels or fuel oils are Nos. 1, 2 and 3 fuel oils, used in heating and as diesel fuel oils, gasoline and jet combustion fuels as previously indicated. The domestic fuel oils generally conform to the specifications set forth in ASTM specification D396-48T. Specifications for diesel fuels are defined in ASTM specification D975-48T. Typical jet fuels are defined in military specification MIL-F-5 624B. In addition, as hereinbefore indicated, fuel oils of varying viscosity and pour points falling both within and outside the indicated ranges may also be effectively treated through the use of the additives of the present invention.

In general additives in accordance herewith are employed in the liquid hydrocarbon fuel in a minor amount, i.e., from about 0.001 to about 10 wt. % and preferably from about 0.01 to 0.5 wt. % based on the total weight of the fuel. Any other known additive (antioxidant, dispersant), generally, may also be used for their known purpose (up to about 5–10 wt. % total composition) in fuel compositions containing the additives hereof without adverse effect.

In general imidazolines such as 1-hydroxethyl-2-alkyl-2-imidazolines are prepared by the reaction of an alkylamino alcohol and a naphthenic acid. Preferably in equimolar amounts. The reaction is usually carried out at a temperature of from about 75° C. to 210° C. and preferably from about 80° C. to 190° C. The alkyl group may contain from 1 to about 36–72 carbon atoms. Naphthenic acids usually are ($C_5$ and $C_6$) cyclopentyl or cyclohexyl acetic acids.

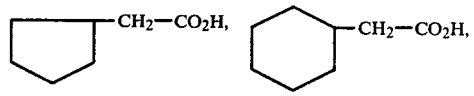

but almost any carboxylic acid can be used having from 1 to 72 carbon atoms.

The bis-imidazoline derivatives are, in general, prepared by reaction of a bis-imidazoline and a $C_{12}$–$C_{36}$, preferably a $C_{18}$–$C_{24}$ alkylsuccinic anhydride or mixture of such anhydrides. Preferably in a molar ratio of 1 to 2. The reaction temperature is in general from about 80° C. to 180° C. and preferably from about 90° C. to 140° C.

DESCRIPTION OF SPECIFIC EMBODIMENTS

The following specific examples and comparative data illustrate the fuel additives and compositions of this invention.

EXAMPLE 1

An imidazoline from the reaction of a naphthenic acid (acid value 167.2) and 2-(2-aminoethylamino) ethanol was prepared in a suitable reaction vessel as follows:

671.0 g. (2 moles) of the naphthenic acid 215 g. (2 moles) of 97% 2-(2-aminoethylamino) ethanol and 200 ml. of toluene were mixed in a reaction vessel and heated to reflux. When the water take-off rate diminished the concentration of toluene in the reaction vessel was decreased, increasing the temperature in the reaction flask. The temperature range varied from 128° C.

(pot temp.) to 185° C. (pot temp.). About 79 ml. of water were taken off (Theory=72 ml.). The reaction mixture was first stripped under house vacuum and then under pump vacuum to 150° C./0.05 mm Hg., to distil over toluene and any light boiling materials. The remainder of the reaction mixture was filtered through a bed of Hi-Flow, and analysis of this filtrate or residue was as follows:

Hydroxy No.; 272: Wt. % N (Total); 6.95 (calculated); 6.71 (obs.): Wt. % Imidazoline; 77.1.

EXAMPLE 2

The reaction product of a bis-imidazoline and a ($C_{18}$–$C_{24}$)-alkylsuccinic anhydride was prepared as follows: 142.0 g. (0.2 moles) of a bis-imidazoline (from reaction of 1 mole of a dimer acid with 2 moles of 2-(2-aminoethylamino) ethanol), 197.0 g. (0.4 moles) of a $C_{18}$–$C_{24}$) -alkylsuccinic anhydride and 200 ml. of toluene were refluxed at 125° C. for 4 hours, and thereafter the solvent was stripped under vacuum to 150° C./0.05 mm Hg.

EXAMPLE 3

A reaction identical to that of Example 2 was carried out except that 0.183 moles of the bis-imidazoline was reacted with 0.366 moles of the alkylsuccinic anhydride.

The above-prepared additives were blended in a fuel composition comprising a gasoline boiling within the range of 88° F. (initial point) to 417° F. (end point).

EXAMPLE 4

101.0 g. (0.25 moles) of the reaction product of a naphthenic acid and 2-(2-aminoethylamino) ethanol was prepared as in Example 1 and thereafter reacted as in Example 2 with 231.5 g. (0.25 moles) of ($C_{18}$–$C_{24}$)$_2$ alkylsuccinic anhydride in 100 ml. of toluene.

EXAMPLE 5

126.0 g. (0.312 moles) of the reaction product of a naphthenic acid and 2-(2-aminoethylamino) ethanol (prepared as in Example 1) was reacted with 100.2 g. (0.312 moles) of isostearic acid and 5 g. of p-toluenesulfonic acid in 100–200 ml. of toluene and heated to reflux.

Refluxing temperature began at 122° C. (pot temperature). As the water came off slowly, toluene was removed so that the pot temperature was slowly raised to 185° C.

When 5.6 ml. or grams of water came off, the reaction product was stripped under house vacuum to 150° C. and then under pump vacuum to 150° C./0.05 mm Hg. Then the pot residue (or product) was filtered through Hi-Flow.

The p-toluenesulfonic acid distills over at the above operating temperatures, 150° C./0.05 mm Hg.

The base fuel, and base fuel containing the additives of Examples 1, 2, 3, 4 and 5 respectively were thereafter subject to the following carburetor detergency test:

I. Object

To determine the effectiveness of fuels and additives in preventing carburetor throttle body deposits.

II. Outline

A six-cylinder, 240 cubic inch truck engine with exhaust gas recirculation is operated for twenty hours on a cycle consisting of a seven-minute idle followed by a thirty-second part-throttle acceleration to 2000 rpm. A controlled amount of the engine's blowby gas is metered into the intake air to induce deposit formation. The ability of a fuel to prevent deposit formation is determined by weighing the removable aluminum throttle sleeve before and after the test and also by a visual rating of the sleeve.

III. Equipment Description

A. Standard Engine

1. Description

| | |
|---|---|
| Truck Engine | 6 in-line OHV |
| Bore | 4.00" |
| Stroke | 3.18" |
| Displacement | 240 cu. in. |
| Compression Ratio | 8.5 |
| Cylinder Numbering | Front to rear, 1-2-3-4-5-6 |
| Firing Order | 1,5,3,6,2,4 |
| Spark Plugs | BF 82 |
| Spark Plug Gap | 0.034" |
| Basic Timing | 6° BTCD @ 700 rpm, vac. discon. |
| Breaker Gap | 0.019" |
| Oil Capacity | 5 qt. |
| Carburetor | Standard commercial model |

The test results are contained in the Table below:

TABLE (Carburetor Detergency Engine Test)

| | |
|---|---|
| Base Fuel | 108 mg. of deposit left on test sleeve |
| Example 1 | Conc. 30 lb/MB<br>8 mg. of deposit left on test sleeve (93% reduction in deposits) |
| Example 2 | Conc. 30 lb/MB<br>46 mg. of deposit left on test sleeve (57% reduction in deposits) |
| Example 3 | Conc. 30 lb/MB<br>54 mg. of deposit left on test sleeve (50% reduction in deposits) |
| Example 4 | Conc. 15 lb/MB<br>82 mg. of deposit left on test sleeve (24% reduction in deposits) |
| Example 5 | Conc. 15 lb/MB<br>27 mg. of deposit left on test sleeve (75% reduction in deposits) |

It is apparent from the data of the Table that the above-described additives of the present invention are highly effective in reducing the formation of carbonaceous deposits from liquid hydrocarbon fuels in internal combustion engines. It will also be understood that although the present invention has been described with preferred embodiments, various modifications and adaptations thereto may be resorted to without departing from the spirit and scope of the invention, as those skilled in the art will readily understand.

I claim:

1. A composition consisting essentially of major amount of a liquid hydrocarbon fuel having an initial boiling point of at least about 75° F. and an end boiling point of about 750° F., and a minor detergency improving amount of the reaction product of a bis-imidazoline and a ($C_{18}$–$C_{24}$) alkylsuccinic anhydride wherein said bis-imidazoline is obtained by reacting a dimer acid and 2-(2-aminoethylamino) ethanol under suitable reaction conditions in a 1 to 2 molar ratio.

2. A composition consisting essentially of a major amount of a liquid hydrocarbon fuel having an initial boiling point of at least about 75° F. and an end boiling point of about 750° F., and a minor detergency improving amount of the reaction product of a naphthenic acid and 2-(2-aminoethylamino) ethanol, and a $(C_{18}-C_{24})_2$ alkylsuccinic anhydride.

3. A composition consisting essentially of a major amount of a liquid hydrocarbon fuel having an initial boiling point of at least about 75° F. and an end boiling point of about 750° F., and a minor detergency improving amount of the reaction product of a naphthenic acid and 2-(2-aminoethylamino) ethanol, and isostearic acid.

* * * * *